United States Patent [19]

Beermann et al.

[11] 4,008,666

[45] Feb. 22, 1977

[54] PERCUSSION IGNITER

[75] Inventors: Paul Beermann, Lendringsen; Wilhelm Grosse-Benne, Menden, both of Germany

[73] Assignee: Hagenuk & Co. GmbH, Menden-Lendringsen, Germany

[22] Filed: Feb. 25, 1975

[21] Appl. No.: 552,783

[30] Foreign Application Priority Data

Feb. 26, 1974 Germany ..... 7406694

[52] U.S. Cl. ..... 102/70 R; 102/8; 102/70 S

[51] Int. Cl.[2] ..... F42C 15/00

[58] Field of Search ..... 102/70 R, 70 S, 8, 16, 102/86.5, 81.6, 73 A

[56] References Cited

UNITED STATES PATENTS

| | | | |
|---|---|---|---|
| 2,667,838 | 2/1954 | Cook | 102/8 X |
| 3,205,817 | 9/1965 | Madlener et al. | 102/8 |
| 3,260,206 | 7/1966 | Beermann et al. | 102/70 R |
| 3,575,110 | 4/1971 | Conroy et al. | 102/8 |
| 3,596,601 | 8/1971 | Kolf | 102/70 S |
| 3,831,521 | 8/1974 | Engeli | 102/70 R X |
| 3,901,155 | 8/1975 | Huber | 102/70 R |

FOREIGN PATENTS OR APPLICATIONS

| | | | |
|---|---|---|---|
| 1,336,332 | 7/1963 | France | 102/70 R |
| 1,086,595 | 8/1960 | Germany | 102/70 R |

*Primary Examiner*—David H. Brown
*Attorney, Agent, or Firm*—Michael J. Striker

[57] ABSTRACT

A watertight and corrosion-resistant percussion igniter has a housing, a percussion cap in the housing and a firing pin mounted in the housing and having a free end spaced from and adapted to impact the percussion cap. A one-piece tubular holder surrounds the firing pin and has at least one transverse hole, and a retaining member is located in the hole and engages in a depression formed in the firing pin. A biasing spring biases the firing pin towards the percussion cap and makes the free end of the firing pin impact the cap when the retaining member becomes disengaged from the depression so that the firing pin can move relative to the tubular holder.

9 Claims, 5 Drawing Figures

FIG. 1
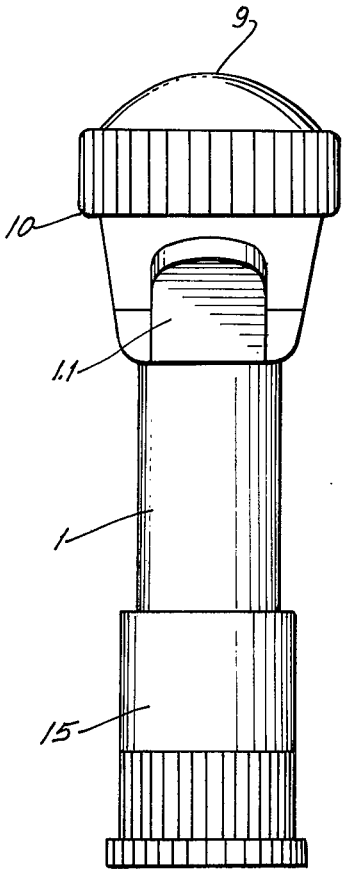
FIG. 2
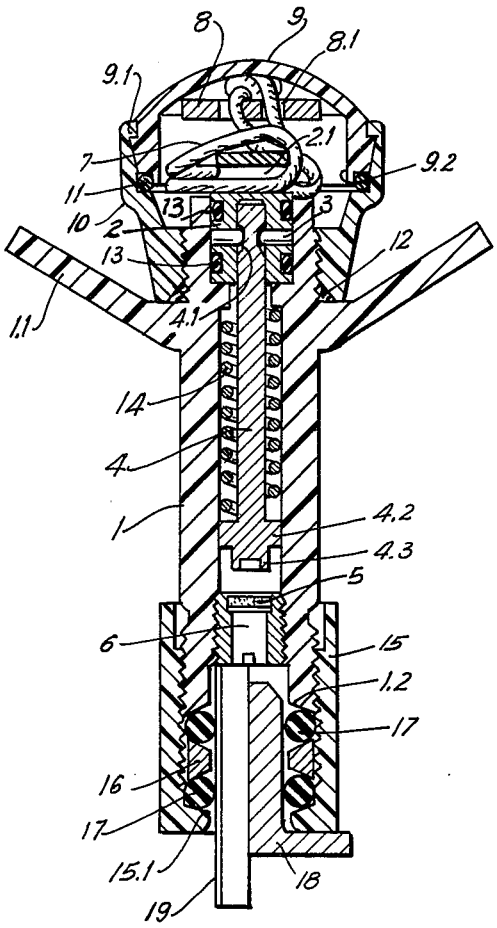
FIG. 3B
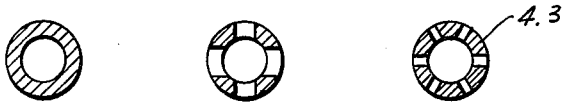
FIG. 3A FIG. 3C

PERCUSSION IGNITER

BACKGROUND OF THE INVENTION

The present invention relates generally to a percussion igniter, and more particularly to a percussion igniter of the type which detonates a firing cap that in turn starts a cord-type fuse burning.

It is known from the prior art to provide percussion igniters of this type in which the entire construction is of metal and therefore heavy and expensive. Moreover, the igniter of the prior art is not watertight; it is coated with a lacquer and in order to operate this igniter the head of the same is screwed off in order to gain access to the ripcord which must be pulled to operate the igniter. As this is done, the lacquer breaks off and water can enter into the interior of the igniter. If for any reason the igniter has been made ready for use by unscrewing its cap, then the igniter will remain unsealed even though the cap has been screwed back on.

Moreover, this prior-art construction has a firing pin the free end of which, i.e. the end which is to impact the percussion cap, has only two contact faces for engagement with the percussion cap and it has been observed that this is not sufficient to absolutely guarantee impacting upon the percussion cap in such a manner that the latter will always and under all circumstances be detonated.

Finally, the prior-art igniter also has the further disadvantage that the cord-type fuse is not well mounted. It extends through a flexible tube which is compressed by turning a threaded sleeve; experience has shown that this arrangement is neither reliably sealed nor mechanically reliable, since the sleeve can accidentally become unthreaded.

SUMMARY OF THE INVENTION

Accordingly, it is a general object of this invention to provide an improved percussion igniter of the type mentioned earlier.

More particularly, it is an object of this invention to provide a watertight and corrosion-resistant percussion igniter of the ripcord-type which is not possessed of the aforementioned disadvantages.

Another object of this invention is to provide such an improved percussion igniter which is lighter in weight and less expensive to produce.

An additional object of the invention is to provide such an improved percussion igniter which does not require an external coating of lacquer or the like to make it watertight.

In keeping with these objects, and with others which will become apparent hereafter, one feature of the invention resides in a watertight and corrosion-resistant percussion igniter which, briefly stated, comprises a housing, a percussion cap in the housing, and a firing pin mounted in the housing and having a free end spaced from and adapted to impact the percussion cap. A one-piece tubular holding member surrounds the firing pin and has at least one transverse hole. A retaining member is located in this hole and engages in a depression formed in the firing pin. A biasing spring biases the firing pin towards the percussion cap and is operative for making the free end of the firing pin impact the cap when the retaining member becomes disengaged from the depression.

All exposed or outer parts of our novel percussion igniter are advantageously of temperature-resistant and impact-resistant synthetic plastic material, for instance of the type available under the trade name "Makrolon" or under the trade name "Lexan." This eliminates the need for coating the igniter with a lacquer. The identifying marks and symbols which are conventionally provided on percussion igniters can be produced during the molding of the synthetic plastic parts, preferably during injection molding. This represents a further saving in labor and assures that the igniter has a finished appearance without requiring any finishing operations. The synthetic plastic parts can be produced with considerable accuracy, so that many of the testing operations which were previously required to check dimensional accuracy are eliminated, saving further labor and making the device still less expensive.

A particularly important advantage of the construction according to the present invention is that it saves approximately 60% of weight as compared to a similar construction made out of metal. This is especially important if the igniter is used in military applications. Moreover, no corrosion is to be expected, neither during long storage times nor under extreme operating conditions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view of the igniter according to the invention;

FIG. 2 is an axial section through FIG. 1; and

FIGS. 3*a*, 3*b* and 3*c* are end views of the impact end of a firing pin, each Figure showing a different embodiment.

DESCRIPTION OF THE PREFERRED EMBODIMENTS

Referring firstly to FIGS. 1 and 2, it will be seen that reference numeral 1 identifies the housing which is made of synthetic plastic material by injection molding or the like, and which has integral wings 1.1. Arranged in the housing 1 is a carrier 6 which carries a percussion cap 5. Also arranged in the housing is a firing pin 4 whose free end 4.3 is adapted to impact against the percussion cap 5 to detonate the same. This firing pin 4 is slidable in a cylindrical support 2 which has a longitudinal internal passage wherein the firing pin 4 is located; the firing pin 4 is held in place by pins or balls 3; if pins are provided, they have rounded end portions and extend into a depression 4.1 of the firing pin 4. The cylindrical support 2 is provided with one or more transverse holes in which the respective retaining members 3 are located. A spring 14 surrounds the firing pin 4 and bears upon the same in a sense tending to snap it with its free 4.3 against the percussion cap 5 to cause detonation of the latter. A pair of O-rings 13 serves to provide a watertight seal between the housing 1 and the cylindrical support 2.

The cylindrical support 2 is provided with an opening 2.1 through which a rip cord 7 extends which is connected (e.g. knotted) to a retaining washer 8 through an opening 8.1 of which it passes. The retaining washer 8 is located in a cap or head of the device which is composed of an upper portion 9 and a lower portion 10 which are snapped together in that a projection 9.1 of the upper portion 9 non-releasably snaps behind an abutment of the lower portion 10 as shown. An O-ring 11 is provided which fluidtightly seals the interface between the portions 9 and 10; it is held in position by a collar 9.2. A further O-ring 12 is provided which seals the head with respect to the housing 1.

At the lower end of the housing 1 there is provided a fuse retainer 15 having two O-rings 17, a spacer 16 and a plug 18. The fuse is identified with reference numeral 19 and extends alongside the plug 18; in order to indent or constrict the fuse 19 the housing 1 is formed with a recess 1.2 and the fuse retainer 15 is provided with a recess 15.1. The spacer ring 16 is provided with recesses at both axial ends.

The percussion igniter of the present invention is completely watertight due to the provision of the O-rings 11, 12, 13 and 17. Even when the head is unscrewed from the housing 1, the igniter will remain watertight because of the two O-rings 13. The fact that the retaining members 3 are located intermediate the two O-rings 13 assures that no moisture can enter under any circumstances to the region of the retaining members 3, or pass into the area where the retaining members 3 engage the firing pin 4.

In operation, the plug 18 is pulled out and the fuse cord 19 is inserted. To make the igniter or detonator ready for use the head 9, 10 is unscrewed and a rapid pull or jerk is exerted so that the rip cord 7 pulls the holding member 2 axially of the housing 1, causing the retaining members 3 to become disengaged from the recess 4.1 so that the spring 14 can now snap the firing pin 4 towards the percussion cap 5, causing impacting of the free end 4.3 against the percussion cap 5 and thereby detonating the latter.

The igniter remains watertight for a sufficient length of time even as it is being used since, as the support 2 is rapidly pulled axially of the housing 1, as soon as the retaining members 3 can move outwardly of their holes in the support 2 as they move beyond the upper end of the housing 1, they release the firing pin 4 to be snapped by the spring 14 against the percussion cap 5. In this very brief time period it is not possible for ambient water (assuming that the device is set off under water) to reach the percussion cap 5 before or immediately after the latter is engaged by the free end 4.3 of the firing pin.

When the percussion cap 5 is ignited it either sets fire to the fuse 19 which is of the well known type that will burn under water, or else it sets fire to a delay device which is known in the art and located in a delay tube arranged downwardly of the carrier 6.

When the device is operated under water, the entry of water into its interior is obstructed in sequence by the retaining members 3, the lower O-ring, the bore in the housing 1 in which the firing pin 4 is guided, and a collar 4.2 of the firing pin which is engaged by the spring 14. The latter is of rust-free steel, since it has been found that the use of conventional-steel springs is disadvantageous because over a period of time they will tend to rust, despite protective oiling.

If it is found, after the head of the device has been removed for use under water, that the device is not needed after all, then the head is simply threaded back into place and the O-ring 12 again provides a watertight seal.

In the present invention the free end 4.3 of the firing pin 4 is constructed of annular form as shown in FIG. *3a*, or of segmental form as shown in FIGS. *3b* and *3c* because it has been found that these configurations assure an absolutely reliable detonation of the percussion cap 5 on impacting the same.

The use of the two O-rings 17 with axial spacing from one another assures that, when the member 15 is screwed tight, the fuse 19 will be engaged and watertightly sealed at two locations of an annular configuration. The annular contact faces of the two O-rings 17 provide a substantially better constriction and watertight engagement with the fuse 19 than is possible with a flexible tube which can merely be concavely compressed.

It will be understood that each of the elements described above, or two or more together, may also find a useful application in other types of constructions differing from the types described above.

While the invention has been illustrated and described as embodied in a watertight and corrosion-resistant percussion igniter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A watertight and corrosion-resistant percussion igniter comprising a housing; a percussion cap in said housing; a firing pin mounted in said housing for displacement between a retracted position remote from, and an extended position at, said percussion cap and having one end portion adapted to impact the latter in said extended position and another end portion formed with a depression; a biasing spring urging said firing pin toward said extended position; a one-piece holding member mounted in said housing so as to contact the same at a circumferential interface and for displacement between a holding position and a releasing position, said holding member surrounding at least said other end portion of said firing pin in said retracted position of the latter and having at least one transverse hole that opens at said interface; a retaining member received in said hole and engaging in said depression in said holding position of said holding member, and disengaging said firing pin for displacement toward said extended position thereof in said releasing position of said holding member; and means for sealing said interface both in said holding and said releasing position of said holding member, including a first sealing ring at said interface to one side from said retaining member and preventing fluids from penetrating through said interface toward said retaining member and said percussion cap in said holding position of said holding member, and a second sealing ring at said interface to the other side from said retaining member and preventing fluids from penetrating through said interface toward said percussion cap in said releasing position of said holding member.

2. A percussion-igniter as defined in claim 1, wherein said holding member is mounted at one end of said housing; and further comprising a head connected to said one end of said housing; and additional sealing means interposed between said housing and said head and operative for preventing fluids from reaching said holding member so long as said head is connected to said one end of said housing.

3. A percussion-igniter as defined in claim 1, wherein said one end has an endface of annular configuration.

4. A percussion-igniter as defined in claim 1, wherein said one end has a segment-shaped end face.

5. A percussion-igniter as defined in claim 1, said housing having two transversely projecting wings and an end formed with a depression.

6. A percussion-igniter as defined in claim 1; further comprising a fuse cord; and means for retaining said fuse cord, comprising two relatively turnable members formed with cooperating recesses through which said fuse cord extends and wherein it is clampingly retained.

7. A percussion-igniter as defined in claim 1, wherein said retaining member is at least in part rounded.

8. A percussion-igniter as defined in claim 1; further comprising means for effecting relative movement between said holding member and housing so as to cause disengagement of said retaining member from said depression.

9. A percussion-igniter as defined in claim 8, wherein said effecting means comprises a head having an upper and a lower section, an O-ring for sealing said sections relative to one another, and a pair of mutually engageable retaining portions on the respective sections.

* * * * *